United States Patent [19]

Louw

[11] Patent Number: 4,703,878

[45] Date of Patent: Nov. 3, 1987

[54] HANGER WITH GARMENT SUPPORT BAR

[76] Inventor: Henry J. Louw, Dreyersdal Road, Bergvliet, 7800, South Africa

[21] Appl. No.: 908,721

[22] Filed: Sep. 18, 1986

[30] Foreign Application Priority Data

Sep. 30, 1985 [ZA] South Africa ..... 85/7516

[51] Int. Cl.[4] ..... A47G 25/30

[52] U.S. Cl. ..... 223/95; 223/88; D6/315

[58] Field of Search ..... 223/85, DIG. 1, 88, 223/95; D6/315, 323, 326, 327; 211/113

[56] References Cited

U.S. PATENT DOCUMENTS

| | | | |
|---|---|---|---|
| D. 202,240 | 9/1965 | Bissonnette | 223/95 |
| D. 243,055 | 1/1977 | Blumberg | D6/315 |
| 1,447,083 | 2/1923 | Jonas | 223/85 X |
| 2,634,031 | 4/1963 | Klein | 223/88 |
| 3,102,668 | 9/1963 | Milligan | 223/95 |
| 3,896,931 | 7/1975 | Franklin | 223/85 X |

*Primary Examiner*—Werner H. Schroeder
*Assistant Examiner*—Andrew M. Falik
*Attorney, Agent, or Firm*—Larson and Taylor

[57] ABSTRACT

A garment hanger includes a support bar; suspension means adapted to suspend the support bar from a support rail; and a number of garment support elements located spaced apart at least at one end of the support bar. These garment support elements are located at various distances from such end of the support bar. At least some of the garment support elements have an engagement formation adapted to support a garment when engaged therewith and being pulled towards that end of the support bar where such support element is located. Thereby different widths of garments can be suspended from garment hangers, having the same size, so that all suspended garments have a neat appearance and have the same width.

8 Claims, 13 Drawing Figures

FIG. 2
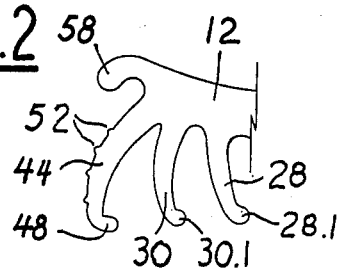
FIG. 4
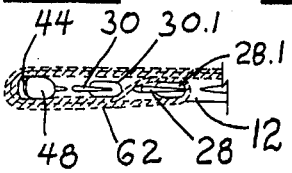
FIG. 3
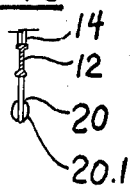
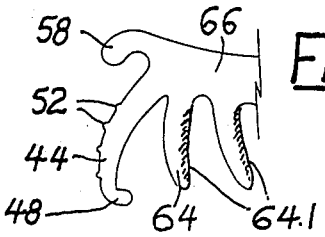
FIG. 6
FIG. 7
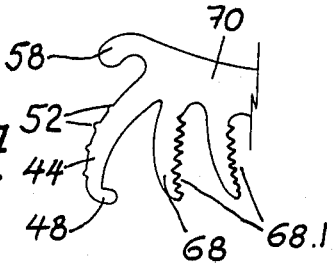
FIG. 8
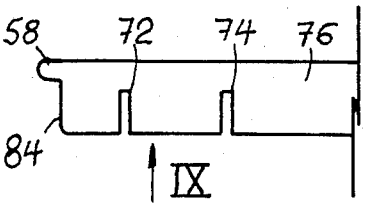
FIG. 10
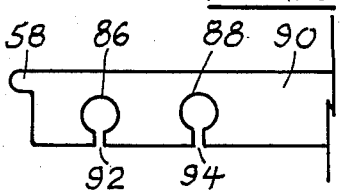
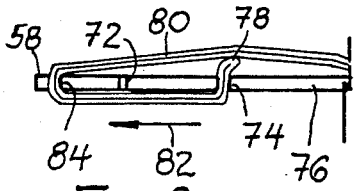
FIG. 9.
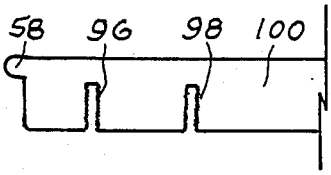
FIG. 11
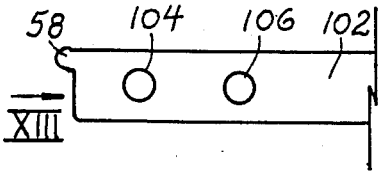
FIG. 12
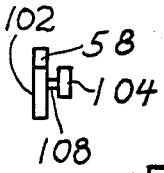
FIG. 13

HANGER WITH GARMENT SUPPORT BAR

FIELD OF INVENTION

The present invention relates to garment hangers.

More particularly, the invention relates to garment hangers for supporting garments such as panties or briefs.

BACKGROUND TO INVENTION

When garment hangers are used to support garments of different widths, it is normal practice to have a hanger with a different support bar width for each type of garment. If only a single support bar width is used for all sizes of garments some garments will fit tightly and neatly, whereas those, which are too wide for the hanger, will hang down loosely and be of unattractive appearance.

In order to ensure that a neat appearance of all garments is obtained, a merchant must use hangers with various support bar widths in order to display the various sizes of garments neatly.

It is an object of the invention to suggest a garment hanger, which will assist in simplifying such display and provide a neat appearance.

SUMMARY OF THE INVENTION

According to the invention, a garment hanger includes a support bar; suspension means adapted to suspend the support bar from a support rail; a number of garment support elements located spaced apart at least at one end of the support bar, these garment support elements being located at various distances from such end of the support bar; the garment support elements extending from the support bar and being slightly curved towards the center of the support bar and at least some of the garment support elements having a hook formation located at the end thereof, such hook formation being directed from the end of the support bar where they are located towards the opposite end of the support bar; and at least some of the garment support elements having an engagement formation adapted to support a garment when engaged therewith and when such a garment is being pulled towards the end of the support bar where such garment support element is located.

At least some of the engagement formations may have an engagement face directed from the end of the support bar where they are located towards the opposite end of the support bar, or at least some of the engagement formations may include a rough surface or a serrated surface or a non-slip surface or a sticky surface facing towards the opposite end of the support bar.

The suspension member may be a hook.

A number of garment support elements may be provided at both ends of the support bar.

The suspension member may extend in one direction from the support bar and the support elements may extend away from the support bar in a direction opposite to the suspension member.

The suspension member, the support bar and the garment support elements may be integrally formed, eg. of synthetic plastics material.

BRIEF DESCRIPTION OF DRAWINGS

The invention will now be described by way of example with reference to the accompanying schematic drawings.

In the drawings there is shown in

FIG. 2 an enlarged view of one end of the hanger support bar illustrated in FIG. 1;

FIG. 3 a sectional end view of part of the hanger support bar seen along arrows III—III in FIG. 1;

FIG. 4 on an enlarged scale, a schematic view seen from below along arrow IV on one end of the hanger support bar illustrated in FIG. 1 for showing how a garment is fitted thereto;

FIG. 6 a front view of part of a second embodiment of a hanger support bar in accordance with the invention;

FIG. 7 a front view of part of a third embodiment of a hanger support bar in accordance with the invention;

FIG. 8 a front view of a fourth embodiment of a garment hanger support bar in accordance with the invention;

FIG. 9 a view from below along arrow IX in FIG. 8 and showing how the end of a garment is fitted to the support bar;

FIG. 10 a front view of part of a fifth embodiment of a hanger support bar in accordance with the invention;

FIG. 11 a front view of part of a sixth embodiment of a hanger support bar in accordance with the invention;

FIG. 12 a front view of part of a seventh embodiment of a hanger support bar in accordance with the invention; and FIG. 13 an end view seen along arrow XIII in FIG. 12.

DETAILED DESCRIPTION OF DRAWINGS

Figure 1:
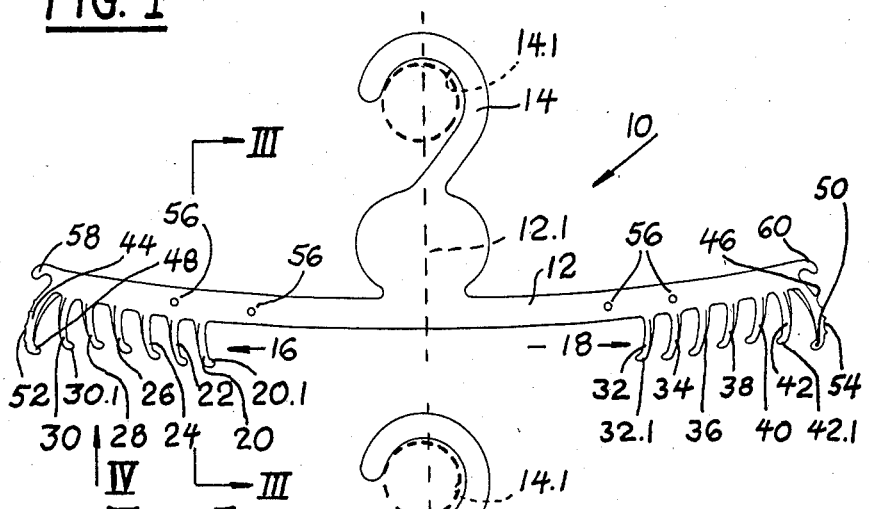
FIG. 1 a front view of a first embodiment of a garment hanger in accordance with the invention.

Referring to FIGS. 1 to 3 of the drawings, the garment hanger 10 includes a hanger support bar 12 having a center 12.1. A suspension hook 14 is formed integrally with the bar 12 for suspending the bar 12 from a support rail 14.1.

Garment support element groups 16 and 18 are provided at both ends of the support bar 12. The group 16 includes individual hooks or arms 20, 22, 24, 26, 28, 30, which each have a widened base section at the bottom in the form of a hook formation 20.1, 22.1, 24.1, 26.1, 28.1, 30.1 directed towards the center 12.1 or opposite end of the support bar 12. Similarly the group 18 includes hooks 32, 34, 36, 38, 40, 42 having hook formations 32.1 . . . 42.1 directed towards the center 12.1 or opposite end of the hanger bar 12.

At both ends of the bar 12 an end support arm 44, 46 is respectively provided, each arm 44, 46 having a hook formation 48, 50 directed to the hanger center 12.1 and further having, at its outwardly directed face, a number of protrusions 52, 54 which are intended to assist in gripping garments to hold them in a non-slip manner on the hanger.

A number of holes 56 may be provided in the bar 12 for attaching labels or tickets, such as promotional labels or tickets.

At its outer upper ends the bar 12 carries end hooks 58, 60, which prevent a fitted garment from slipping upwardly over the ends of the support bar 12.

As is shown in FIG. 3 the bar 12 is of substantially I-section in cross-section.

The hanger 10 is intended in particular to support and display garments being of tubular shape in cross-section and having an elastic section or strip at one end, eg. as is the case with panties or briefs. These garments are provided in different sizes and thereby have different diameters so as to be worn by persons with different waistlines. By means of the support elements 20 . . . 30 and 32 . . . 44 garments of different sizes can be fitted to the same type and size of hanger 10 and the fitted garments all will have the same width appearance. For instance, as shown in FIG. 4, the end of a garment 62 in layflat form can be hooked over the hook 28, the garment 62 then is pulled outwardly and is folded over the end hook 52 below the hook 58, thereafter the garment 62 is extended along the full length of the bar 12 and is folded over the end hook 46 below the hook 60, then the garment 62 is pulled towards the center 12.1 and finally the other end of the garment 62 is fitted over the hook 32. If another garment of a slightly smaller size is to be suspended from the hanger 10, this garment can be fitted onto the hook 30, folded over the end hook 44, then over the end hook 46 and finally is fitted to the hook 34 (or any other hook of the group 18). Thus various sizes of garments, each fitted on a hanger of the type as shown, all will have a width appearance corresponding to the distance between the hooks 44 and 46.

It must be noted that when these garment hangers are suspended from a support rail 14.1, the garments will be displayed neatly. When being fitted, the garment is pulled outwardly on both hooked ends, ie. in a direction away from the center 12.1, and only between the end hooks 52, 54 the force acting on the garment is towards the center 12.1. It also must be noted that a garment cannot be hooked merely between two hooks selected from the groups 16 and 18 (without passing over the end hooks 54, 52) because the garment then would merely slip off. The pulling force on the fitted garment ends therefore must act outwardly and the hook formations 16, 18 of the hanger 10 are shaped to make this possible.

Figure 5:
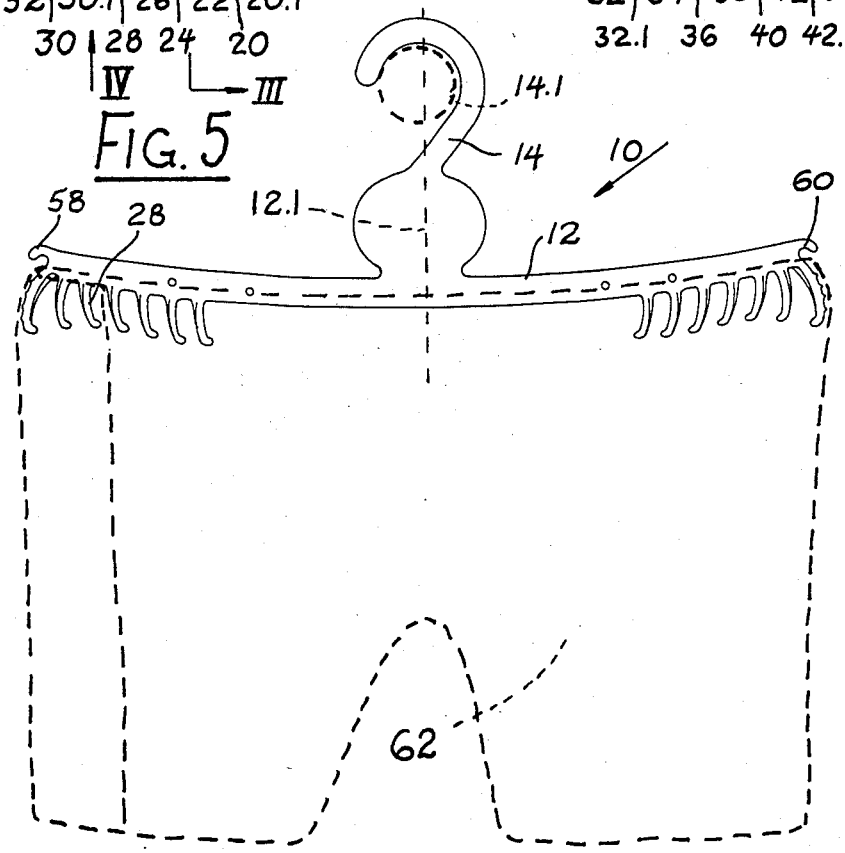
FIG. 5 a view corresponding to FIG. 1 but showing a garment fitted to the garment hanger.

As is shown in FIGS. 1 and 5 the support bar 12 is curved upwardly at both ends. The purpose is to conceal the bar 12 at least partly by means of the garment 62 supported thereby (as is shown in FIG. 5).

In the FIGS. 6 to 13 support elements at one end of a support bar are shown. Obviously similar elements would be provided at the opposite end of the support bar. The end formations of the respective support bars are the same as of the bar 12 and therefore the same reference numerals are used.

FIG. 6 shows a type of support element 64 having a sticky or roughened non-slip surface 64.1 facing towards the hanger center 12.1 of the support bar 66.

FIG. 7 shows another type of support element 68 having a serrated surface 68.1 facing towards the hanger center 12.1 of the support bar 70.

In FIGS. 8 and 9 another type of support element is shown in schematic form. Here the support elements 72, 74 are mere gaps or slots in a support bar 76. The end 78 of a flat-folded garment 80 is merely inserted into the garment gap 74 and the garment 80 then is pulled in the direction indicated by arrow 82 (away from the bar center), is folded over the bar end 84, is pulled towards the other bar end, folded over that end and fitted into a similar slot provided at that end.

The support elements 86, 88 of the bar 90 in FIG. 10 are in the form of circular cut-outs with a narrow insertion throat 92, 94. The functioning thereof is similar to the elements 72, 74 of FIGS. 8 and 9.

In FIG. 11 the support elements are slots 96, 98 provided in the support bar 100 and have serrated edges to facilitate gripping.

Finally, as is shown in FIGS. 12 and 13, the bar 102 is provided with support elements in the form of knobs 104, 106 supported by pins 108, etc. A garment is merely hooked over such a knob 104, 106 and is pulled towards the end of the bar for fitting as described above.

The garment hangers as illustrated in the various drawings may be injection moulded from any suitable synthetic plastics material (such as polypropylene, high density polyethylene, polystyrene or A.B.S.).

I claim:

1. A garment hanger, which includes a support bar; suspension means adapted to suspend the support bar from a support rail; a number of garment support elements located spaced apart at least at one end of the support bar; said garment support elements being located at various distances from such end of the support bar; the garment support elements extending from the support bar and being slightly curved towards the center of the support bar and at least some of the garment support elements having a hook formation located at the end thereof; each said hook formation being directed from the end of the support bar at which that hook formation is located towards the opposite end of the support bar; at least some of the garment support elements having an engagement formation adapted to support a garment when engaged therewith and when such a garment is being pulled towards the end of the support bar where such garment support element is located; and at least some of the engagement formations have an engagement face directed from the end of the support bar at which the corresponding garment formation is located towards the opposite end of the support bar.

2. A garment hanger as claimed in claim 1, in which at least some of the engagement formations include a rough surface facing towards the opposite end of the support bar.

3. A garment hanger as claimed in claim 1, in which at least some of the engagement formations include a serrated surface facing towards the opposite end of the support bar.

4. A garment hanger as claimed in claim 1, in which at least some of the engagement formations include a non-slip surface facing towards the opposite end of the support bar.

5. A garment hanger as claimed in claim 1, in which some of the engagement formations include a sticky surface facing towards the opposite end of the support bar.

6. A garment hanger as claimed in claim 1, in which a number of garment support elements are provided at both ends of the support bar.

7. A garment hanger as claimed in claim 1, in which the suspension member extends in one direction from the support bar and the support elements extend away from the support bar in a direction opposite to that of the suspension member.

8. A garment hanger as claimed in claim 1, in which the suspension member, the support bar and the garment support elements are integrally formed of synthetic plastics material.

* * * * *